US006206715B1

(12) United States Patent
Liu et al.

(10) Patent No.: US 6,206,715 B1
(45) Date of Patent: Mar. 27, 2001

(54) ACTUATING TOOL FOR USE WITH ZIF SOCKETS

(75) Inventors: Eric Liu; Pao Lung Lin; Chun-Hsin Lu, all of Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/447,749

(22) Filed: Nov. 22, 1999

(30) Foreign Application Priority Data

Jul. 14, 1999 (TW) ..... 88211703

(51) Int. Cl.[7] ..... H01R 13/625
(52) U.S. Cl. ..... 439/342
(58) Field of Search ..... 439/342, 259–270

(56) References Cited

U.S. PATENT DOCUMENTS 5,649,836 * 7/1997 Kashiwagi ..... 439/342
5,658,160 * 8/1997 Kashiwagi ..... 439/342
5,707,247 * 1/1998 Konstad ..... 439/342
5,730,615 * 3/1998 Lai et al. ..... 439/342
5,855,489 * 1/1999 Walker ..... 439/342

* cited by examiner

*Primary Examiner*—Gary F. Paumen
(74) *Attorney, Agent, or Firm*—Wei Te Chung

(57) ABSTRACT

An actuating tool for use with a ZIF socket is integrally formed and uses a rotational operation. It comprises a shaft, a positioning portion, a standoff, a driving portion and a handle. The shaft has two opposite ends and defines a rotational axis. One end thereof forms the handle and the other end thereof forms, sequentially downward, the driving portion, the standoff and the positioning portion. The positioning portion is engaged in a shaft hole defined in a printed circuit board. The driving portion defines a cam for drive a moveable component of the ZIF socket. The handle is paddle-shaped and is adapted to impart a torsional force to the shaft by a rotating operation.

1 Claim, 2 Drawing Sheets

ACTUATING TOOL FOR USE WITH ZIF SOCKETS

BACKGROUND OF THE INVENTION

The present invention relates to an actuating tool, and particularly to an actuating tool for use with a zero insertion force (ZIF) socket which features compact structure and easy to use.

Taiwan patent application No. 84204249 discloses a prior art mechanism for opening or closing a ZIF socket. The ZIF socket connector comprises, a base and a cover movably assembled to the base, and a lever for driving the cover. A CPU is mounted on the cover with its pins extending through holes thereof and into the base. When the lever is moved, the cover is driven to slide along the base, thereby connecting or disconnecting the pins of the CPU to/from contacts in the base, subjecting the pins and contacts to very little force. However, the design is complicated and the space required is fairly large which does not accord with the trend toward small, simple connectors in computers.

A second prior art ZIF connector is shown in FIG. 1. The electrical connector comprises a base 10 which forms a notch 14 at two opposite comers and a cover 12 movably assembled to the base 10. In operation, a screw driver 18 is placed into the notch 14 and pushed against the cover 12, thereby push the cover 12 to slide over the base 10 between an open position and a closed position, causing a CPU 16 mounted thereon to be connected or disconnected to/from contacts in the base 10. This arrangement is simple but can be hazardous to the connector or to the CPU if the operator is not careful, so a new design is desired.

BRIEF SUMMARY OF THE INVENTION

A first object of the present invention is to provide an actuating tool which is simple in structure, safe and reliable for use with a ZIF socket.

A second object of the present invention is to provide an actuating tool for use with a ZIF socket which is convenient and quick in operation and requires a reduced space in a computer.

An actuating tool for use with a ZIF socket is integrally formed and uses a rotational operation. It comprises a shaft, a positioning portion, a standoff, a driving portion and a handle. The shaft forms two opposite ends and a longitudinal rotational axis therebetween. One end of the shaft forms the handle, the other end thereof comprises, sequentially downward, a driving portion, a standoff and a positioning potion. The positioning portion engages the actuating tool with a shaft hole in a printed circuit board. The standoff is formed between the positioning portion and the driving portion. The driving portion is adapted for driving a cover of the ZIF socket. The handle is paddle-shaped for imparting a torsional force to the shaft.

Other objects, advantages and novel features of the invention will become more apparent from the following detailed description of the present embodiment when taken in conjunction with the accompanying drawings.

DETAILED DESCRIPTION OF THE INVENTION

Figure 1:
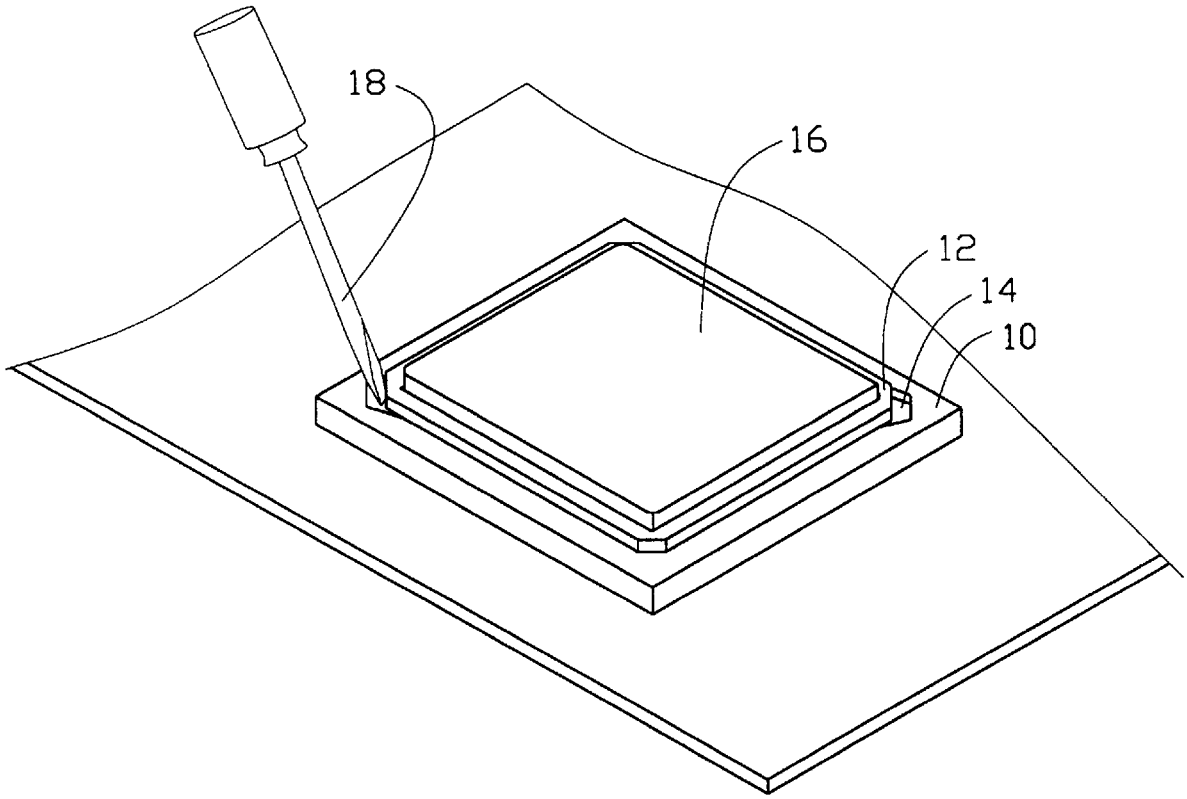
FIG. 1 (PRIOR ART)
FIG. 1 is a perspective view of a prior art electrical connector and its related elements.
Figure 2:
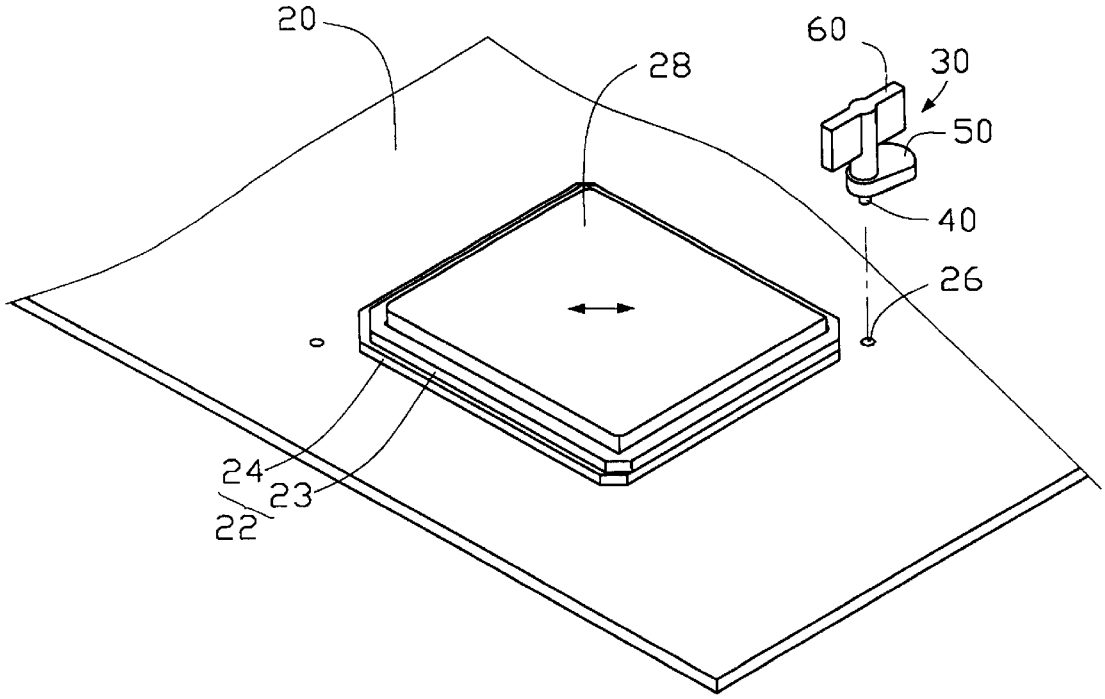
FIG. 2 is a perspective view of an actuating tool of the present invention for use with a ZIF socket.

Referring to FIG. 2, a ZIF socket 22 comprises a base 24 for soldering to a printed circuit board 20 and a cover 23 movable assembled to the base 24. The printed circuit board 20 defines a shaft hole 26 near each of two opposite comers of the ZIF socket 22 to cooperate with an actuating tool 30 in opening and closing the ZIF socket.

Figure 3:
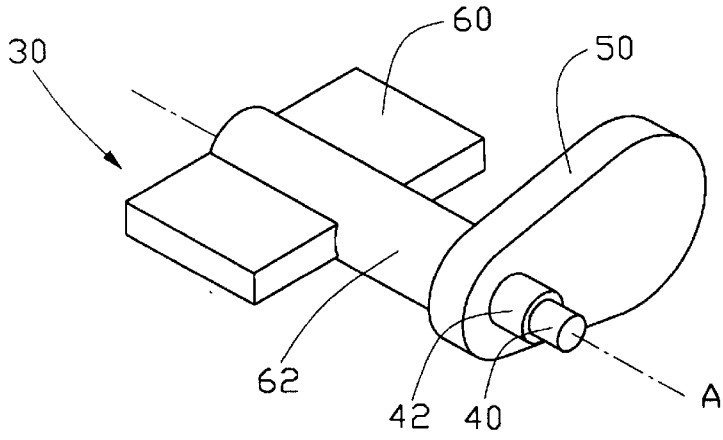
FIG. 3 is an enlarged perspective view from another angle of the actuating tool of FIG. 2.

Referring to FIGS. 2, 3, the actuating tool 30 is integrally formed for a rotational operation about a rotational axis thereof and comprises a cylindrical shaft 62, having a handle 60 at an upper end, and forming, sequentially downward, a driving portion 50, a standoff 42 and a positioning portion 40 at a lower end. The shaft 62 defines a longitudinal axis of rotation A. The handle 60 is paddle-shaped and is adapted to impart a torsional force to the shaft 62 from a user's fingers. Additionally, the dimensions of the height of the shaft 62 and the handle 60 are adapted to assure free rotation of the handle 60 without hitting a CPU 28 or the cover 23 of the ZIF socket during operation of the actuating tool 30. The cylindrical positioning portion 40 is at a lowermost end of the actuating tool 30 and has a diameter slightly less than that of the shaft hole 26, and is adapted to engage the actuating tool 30 with the shaft hole 26 in the printed circuit board 20. The cylindrical standoff 42 is formed between the positioning portion 40 and the driving portion 50 and has a diameter larger than the diameter of the shaft hole 26. A height of the standoff 42 is slightly greater than a thickness of the base 24 of the ZIF socket 22. The shaft 62, the standoff 42 and the positioning portion 40 are all symmetric about the axis of rotation A. The driving portion 50 is cam-shaped and is formed proximate the shaft 62 in a plane perpendicular to the axis of rotation A. The driving potion 50 is adapted to translate a torsional motion in the actuating tool 30 into a linear pushing motion away from the axis of rotation A.

In operation, the positioning portion 40 of the actuating tool 30 is inserted into the shaft hole 26 in the printed circuit board 20, next to a ZIF socket 22 which includes a base 24 and a cover 23 and which mounts a CPU in said cover 23. The actuating tool 30 is held with the axis of rotation A perpendicular to the plane of the printed circuit board 20 while at the same time a torsional force is imparted to the actuating tool 30 through the handle 60. The subsequent rotation of the actuating tool 30 rotates the driving portion 50 so that it passes over a top surface of the base 24 of the ZIF socket 22 and makes contact along its cammed surface with an edge of the cover 23, pushing the cover 23 to an opposite side of the base 24, thereby opening or closing the ZIF socket. The opposite operation (closing or opening of the ZIF socket) is accomplished by repeating the above operation using the shaft hole 26 on the opposite side of the ZIF socket 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An actuating tool for use with a zero insertion force socket connector mounted on a printed circuit board having a shaft hole adjacent to said socket connector, said socket connector including a component adapted for being driven by said actuating tool, comprising:

a shaft having first and second ends and a longitudinal axis extending between said first and second ends;

a positioning portion being formed on said second end of the shaft and being adapted for rotatable assembly to said hole of said printed circuit board;

a handle being formed on said first end of the shaft for manipulating the shaft to rotate centered on said hole; and a driving portion being formed on said shaft for driving said component to move with respect to the rest of said socket connector;

wherein the positioning portion and the driving portion are formed integrally and have a rotational axis identical to that of the shaft;

wherein the shaft is cylindrical in shape and has a height above a chip mounted on the movable component of the Socket connector;

wherein the driving portion comprises a cam and is formed adjacent to said second end of the shaft;

wherein the positioning portion is cylindrical in shape and has a diameter slightly less than that of the hole of the printed circuit board;

wherein a standoff is formed between the driving portion and the positioning portion, the standoff being cylindrical in shape and having a specified diameter larger than that of the hole in the printed circuit board and a height not lower than a thickness of a base of the socket connector;

wherein the handle comprises two planar protrusions extending from the shaft in diametrically opposite directions.

* * * * *